US010584933B2

(12) United States Patent
Lagenbeck

(10) Patent No.: US 10,584,933 B2
(45) Date of Patent: Mar. 10, 2020

(54) FIREARM BARREL COOLING SYSTEM

(71) Applicant: Keith A. Lagenbeck, Arlington, TX (US)

(72) Inventor: Keith A. Lagenbeck, Arlington, TX (US)

( * ) Notice: Subject to any disclaimer, the term of this patent is extended or adjusted under 35 U.S.C. 154(b) by 0 days.

(21) Appl. No.: 15/863,900

(22) Filed: Jan. 6, 2018

(65) Prior Publication Data

US 2018/0120044 A1 May 3, 2018

Related U.S. Application Data

(63) Continuation-in-part of application No. 15/072,473, filed on Mar. 17, 2016, now abandoned.

(51) Int. Cl.
*F41A 21/24* (2006.01)
*F41A 13/12* (2006.01)

(52) U.S. Cl.
CPC ..... *F41A 21/24* (2013.01); *F41A 13/12* (2013.01)

(58) Field of Classification Search
CPC ..... F41A 21/24; F41A 13/12
USPC ..... D22/108
See application file for complete search history.

(56) References Cited

U.S. PATENT DOCUMENTS 8,025,003 B1 * 9/2011 Saur ..... F41A 21/24 42/76.01
9,207,031 B2 * 12/2015 Balthaser ..... F41A 21/44
D763,392 S * 8/2016 Miller, III ..... D22/108
D782,598 S * 3/2017 Faxon ..... D22/108
D790,647 S * 6/2017 Miller, III ..... D22/108
9,677,838 B2 * 6/2017 Faxon ..... F41A 21/24

OTHER PUBLICATIONS

"Fluted Barrels", Lilja, http://riflebarrels.com/fluting/, (Year: 2015).*
"Barrel Fluting", Area 419, https://www.area419.com/product/barrel-fluting, (Year: 2016).*
Reaser, Rob, "See the "Coolest" AR Upgrade on the Market Today!", http://www.shootingdaily.com/articles/see-the-coolest-ar-upgrade-on-the-market-today, (Year: 2015).*
"Barrel Fluting Process", LWRCi , https://www.youtube.com/watch?v=CgJc3mJPelw, (Year: 2014).*
"Contouring BN36 300 Win Barrel in one step", Noreen Firearms, https://www.youtube.com/watch?v=c2CBPxs8Z0w, (Year: 2015).*

* cited by examiner

*Primary Examiner* — Joshua T Semick
(74) *Attorney, Agent, or Firm* — Lyman Moulton, Esq.

(57) ABSTRACT

A firearm barrel cooling system includes fins formed to extend around and from a barrel blank of a same material as the fins. An outside major diameter of the fins is greater than an outside diameter of the formed barrel near a shank of the barrel. Flutes are defined around and in the barrel blank between adjacent fins wherein an outside diameter of the flutes is equal to a minor diameter of the fins and equal to or greater than an outside diameter of the barrel. A transition from a crest of a flute to a base of a fin coincides with a taper of the formed barrel from shank to muzzle. Fin cooling sections are located between a barrel collar and a muzzle end of the formed barrel, each cooling section having a plurality of fins. A method for cooling a firearm barrel system therefore is also included herein.

4 Claims, 8 Drawing Sheets

FIREARM BARREL COOLING SYSTEM

CROSS-REFERENCE TO RELATED APPLICATION

This application is a Continuation if Part of and claims the benefit and priority date of earlier filed U.S. patent application Ser. No. 15/072,473 titled 'Firearm Barrel Cooling System,' filed Mar. 17, 2016 by Keith A. Langenbeck incorporated herein by reference in its entirety and U.S. Provisional Patent Application Ser. No. 62/136,475 also titled 'Firearm Barrel Cooling System' filed Mar. 21, 2015 by Keith A. Langenbeck incorporated herein by reference in its entirety.

BACKGROUND OF THE INVENTION

Weapons like the AR15/M16/M4 are capable of firing in full automatic mode but seldom are for various reasons. Chief among those reasons is the rapid accumulation of heat first in the barrel and then throughout the rest of the firing mechanisms. Among the problems caused by accumulated heat not being rejected from the rifle are: (1) thermal expansion causing lock up of the metal pieces in the mechanisms that extract spent shells from the chamber and load new shells from the magazine, (2) auto-discharge of the cartridge when loaded into the hot chamber without the firing pin striking the cartridge primer (aka 'cook-off'), (3) rupture of the weakened barrel and (4) rupture of the weakened gas tube, which transfers hot combustion gases from the barrel first through the gas block and then into the upper receiver to cycle the action.

Designing a rifle to ameliorate elevating barrel temperatures has in the past conflicted with the need for a light weight rifle that can be readily carried by a single person. A major portion of the total rifle weight, which ranges from 6 to 8 pounds for AR15/M16/M4, is contributed by the barrel itself. Elevated barrel temperatures also cause severe degradation in rifle accuracy. As the metal barrel gets hot, it becomes less rigid, flexing more when fired and causing the bullet trajectory to be erratic. Further complicating the design of a barrel cooling system for weapons like the AR15/M16/M4 is the size, function and location of the gas block, which is located typically near the midpoint of the barrel overall length.

SUMMARY OF THE INVENTION

A firearm barrel cooling system comprising a plurality of fins adapted to extend around and formed from a solid barrel blank of a same material as the fins is disclosed. An outside major diameter of the fins is greater than an outside diameter of the barrel at any point of the barrel. A plurality of flutes are defined around and in the one piece formed barrel between adjacent fins wherein an inside diameter of the flutes is less than the outside diameter of the formed barrel.

Also, a plurality of flutes are defined around and in the one piece formed barrel between adjacent fins wherein an inside diameter of the fins is equal to a minor diameter of the fins and less than an outside diameter of the formed barrel. A plurality of cooling sections are located between a barrel collar and a muzzle end of the one piece formed barrel, each cooling section having a plurality of fins having a major outer diameter and a minor inner diameter.

A firearm barrel cooling method comprising forming a plurality of fins adapted to extend around and above a one-piece barrel blank of a same material as the fins wherein an outside major diameter of the fins is greater than an outside diameter of the formed barrel at any point of the formed barrel. The method also includes forming a plurality of flutes defined around and in the one-piece formed barrel between adjacent fins wherein an inside diameter of the flutes is equal to a minor diameter of the fins and less than an outside diameter of the formed barrel. The method additionally includes forming a plurality of cooling sections between a barrel collar and a muzzle end of the one-piece formed barrel, each cooling section having a plurality of fins having a major outer diameter and a minor inner diameter.

Other aspects and advantages of embodiments of the disclosure will become apparent from the following detailed description, taken in conjunction with the accompanying drawings, illustrated by way of example of the principles of the disclosure.

Figure 1:
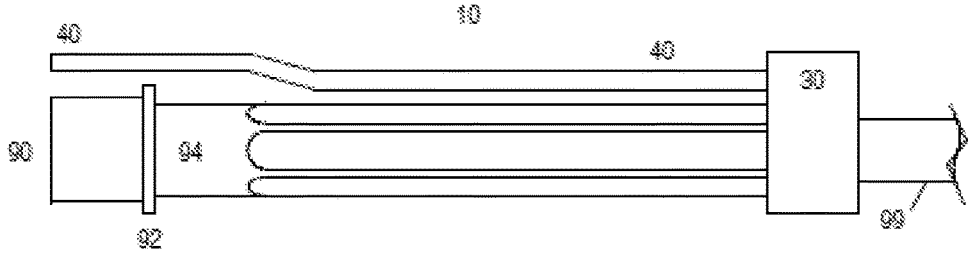
FIG. 1 depicts a side view of the barrel system, from an AR15/M16/M4 pattern rifle in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention. The term 'nominal' used throughout the disclosure is in reference to a common definition of the term meaning of or relating to a designated or theoretical size that may vary from the actual size or dimension. Also, the term 'inverted fin' and the term 'flute,' refers to a cavity, an 'inverted fin' or space between fins and is therefore synonymous throughout the disclosure with the terms 'cavity,' 'cavities' and 'space' though more descriptive than either synonymous term. The term 'barrel blank' refers to a blank stock before machining per the disclosure to a 'formed barrel' including fins and flutes. The terms 'blank stock,' 'barrel blank,' 'blank barrel,' 'blank barrel stock,' are synonymous throughout the disclosure. The term 'divot' refers to a common definition of the term as a piece of material cut out of stock by making a cutting stroke.

This present application discloses barrel designs and passive barrel cooling systems that: (1) rapidly reject or dissipate the combustion heat passed into the rifle barrel from discharge of the cartridge, (2) accommodate the location and function of the gas block, (3) reduce barrel weight in comparison to larger diameter, heavier 'bull' barrels, (4) ensure proper positioning of the barrel cooling system during installation, (5) maintain proper positioning of the barrel cooling system during firing and (6) insure the accuracy is maintained by attenuating barrel flex when the rifle is fired.

FIGS. 1 through 8 illustrate a first example of this barrel cooling system. FIG. 1 depicts a side view of the barrel system, Item 10, from an AR15/M16/M4 pattern rifle. Item 90 is the barrel itself. Item 92 is the barrel lug or collar that abuts with the upper receiver of the rifle, which is not shown. Item 94 is the portion of the barrel immediately after the barrel lug. Item 30 is the gas block that receives a portion of the combustion gases, which are redirected through the gas tube, Item 40, back toward the upper receiver to operate the mechanisms configured to eject a spent cartridge. Item 99 is the portion of the barrel at the gas block. The dimension at the bottom of opposing flutes, Item 95, is nominally the same or slightly more than outside diameter of the barrel at the gas block location, Item 99. Different than current barrel designs, with flutes that terminate before the gas block position, the flutes continue completely out to the gas block position, Item 99. The fins that result from this flute design provide sufficient means to locate the gas block, Item 30, along the barrel. Machining the flutes, Item 95, into the exterior of the barrel and all the way out to the gas block position maximizes the length of the flutes and reduces barrel weight without compromising barrel strength.

Figure 2:
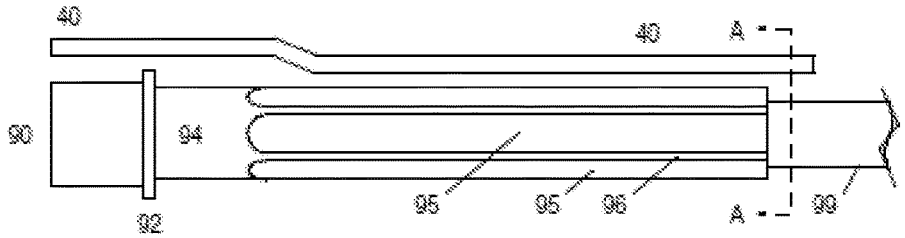
FIG. 2 illustrates a side view of the arc shaped flutes, that have been cut down and into the barrel after the barrel lug in accordance with an embodiment of the present disclosure.

FIG. 2 illustrates a side view of the arc shaped flutes, Item 95, that have been cut down and into the barrel after the barrel lug. There are corresponding ribs, Item 96, that result from the machining of these flutes, which are uniformly spaced around the barrel. The gas block has been removed for reasons of illustration and clarity.

Figure 3:
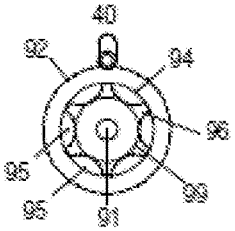
FIG. 3 illustrates a cross section, A-A, of FIG. 2 depicting the barrel flutes, the barrel ribs, the barrel collar and the bore of the barrel, through which the bullets pass and other details of the barrel design in accordance with an embodiment of the present disclosure.

FIG. 3 illustrates a cross section, A-A, of FIG. 2 that depicts the barrel flutes, Item 95, the barrel ribs, Item 96, the barrel collar, Item 92, the bore of the barrel, Item 91, through which the bullets pass and other details of the barrel design. The machining of the flutes into the barrel is continuous to the location of the gas block, such that the vertical faces or ends of the ribs, Item 96, as seen in FIG. 3 can be used to position the gas block along the barrel.

Figure 4:
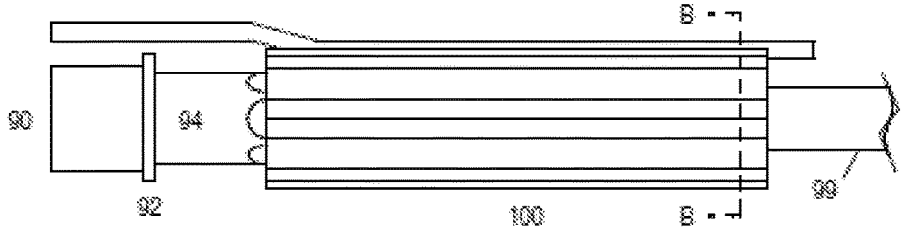
FIG. 4 illustrates a side view of the aluminum cooling extrusions, located in the fluted portion of the barrel in accordance with an embodiment of the present disclosure.

FIG. 4 illustrates a side view of the aluminum cooling extrusions, Item 100, located in the fluted portion of the barrel. Same reference numbers may be used for same and similar components illustrated in other figures in the present disclosure.

Figure 5:
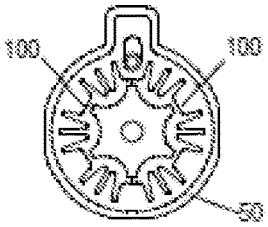
FIG. 5 illustrates a cross section, B-B, of FIG. 4 depicting two aluminum cooling extrusions, in a conformal arrangement with the fluted portion of the barrel in accordance with an embodiment of the present disclosure.

FIG. 5 illustrates a cross section, B-B, of FIG. 4 that depicts two aluminum cooling extrusions, Item 100, in a conformal arrangement with the fluted portion of the barrel. Also illustrated in FIG. 5 is a hand guard, Item 50, that fully surrounds the barrel, barrel cooling extrusions and the gas tube. Although not shown in any other figure, the hand guard is extensively ventilated to allow heat to pass from the cooling extrusions to the surrounding air. The hand guard is an integral part of the rifle system and is not shown in any other figures for reasons of clarity.

Figure 6:
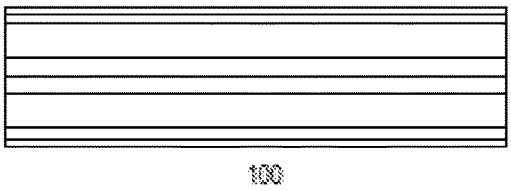
FIG. 6 illustrates a side view of the cooling extrusion in accordance with an embodiment of the present disclosure.

FIG. 6 illustrates a side view of the cooling extrusion, Item 100. Same reference numbers may be used for same and similar components illustrated in other figures in the present disclosure.

Figure 7:
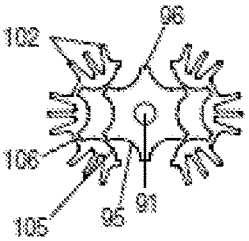
FIG. 7 illustrates an end view of two cooling extrusions removed from the conformal engagement with the fluted portion of the barrel in accordance with an embodiment of the present disclosure.

FIG. 7 illustrates an end view of two cooling extrusions removed from the conformal engagement with the fluted portion of the barrel. The interior surfaces of the cooling extrusion, Item 105 and Item 106, correspond to the exterior surfaces of the fluted barrel, Item 95 and Item 96, respectively. Cooling fins, Item 102, are depicted in FIG. 7 as well. These fins increase the surface area exposed to the atmosphere increasing heat transfer from and cooling of the barrel.

Figure 8:
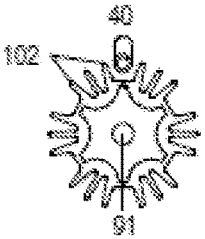
FIG. 8 illustrates an end view of the two cooling extrusions having been attached to the fluted portion of the barrel in accordance with an embodiment of the present disclosure.

FIG. 8 illustrates an end view of the two cooling extrusions having been attached to the fluted portion of the barrel. The cooling extrusions would be affixed to the barrel by pressure being exerted along its length and in toward the bore of the barrel. This pressure will spread or flex open the cooling extrusions until the dimensional obstruction between Item 96 and Item 105, as seen in FIG. 7, is cleared and the cooling extrusion will snap into a conformal arrangement with the fluted barrel. This 'one-way' means of attachment precludes any external fasteners or other means of affixing the cooling extrusions to the fluted barrel.

Anticipated in this disclosure but not depicted, thermally conductive adhesives can also be used in the attachment of the cooling extrusions to the barrel to accommodate dimensional variances and maximize heat transfer performance. Thermally conductive adhesives are known in the semiconductor industry when heat sinks are attached to computer microprocessor chips.

Figure 9:
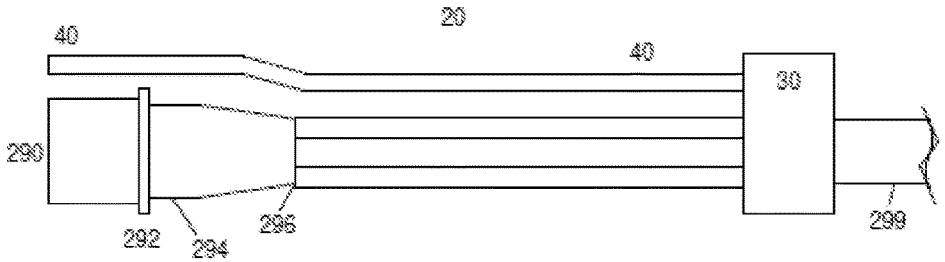
FIG. 9 is a side view that depicts a barrel system, from an AR15/M16/M4 pattern rifle in accordance with an embodiment of the present disclosure.

FIGS. 9 through 14 depict a second example of this barrel cooling system. FIG. 9 is a side view that depicts a barrel system, Item 20, from an AR15/M16/M4 pattern rifle. Item 290 is the barrel itself. Item 292 is the barrel lug or collar that abuts with the upper receiver of the rifle, which is not shown. Item 294 is the portion of the barrel immediately after the barrel lug. Item 30 is the gas block that receives a portion of the combustion gases, which are redirected through the gas tube, Item 40, back toward the upper receiver to operate the mechanisms to eject a spent cartridge. Item 299 is the portion of the barrel after the gas block.

Figure 10:
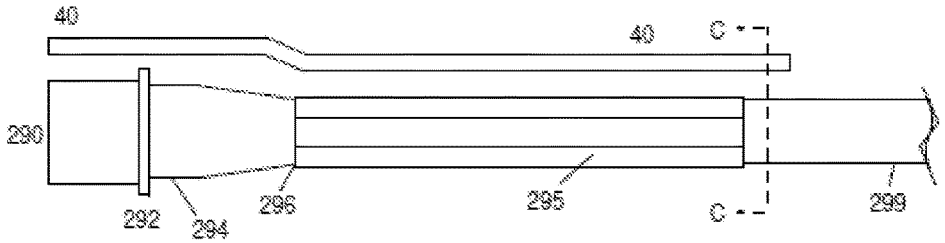
FIG. 10 is a side view that illustrates eight uniform, flat faced surfaces cut into the barrel after the barrel lug in accordance with an embodiment of the present disclosure.

FIG. 10 is a side view that illustrates eight uniform, flat faced surfaces, Item 295, that have been cut into the barrel after the barrel lug. The diameter of the barrel, Item 296, immediately prior to the octagonal portion of the barrel is nominally the same as the dimension between opposing parallel flats, Item 295. The gas block has been removed for reasons of illustration and clarity.

Figure 11:
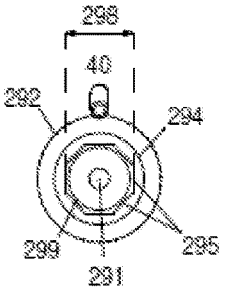
FIG. 11 depicts a cross section, C-C, from FIG. 10 that illustrates the uniform eight flat surfaces, that have been cut into the barrel after the barrel lug in accordance with an embodiment of the present disclosure.

FIG. 11 depicts a cross section, C-C, from FIG. 10 that illustrates the uniform eight flat surfaces, Item 295, that have been cut into the barrel after the barrel lug. The diameter of the barrel immediately prior to the octagonal portion of the barrel, Item 296, is nominally the same as the dimension between two parallel flats, Item 298. The bore of the barrel, Item 291, through which the bullets pass and other details of the barrel design are also depicted.

Figure 12:
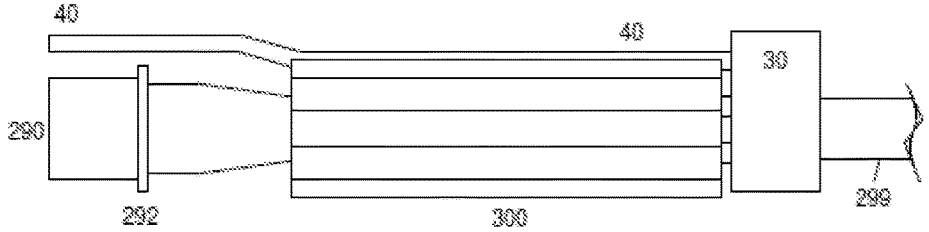
FIG. 12 is a side view that depicts another aluminum cooling extrusion, located on the octagonal portion of the barrel in accordance with an embodiment of the present disclosure.

FIG. 12 is a side view that depicts another aluminum cooling extrusion, Item 300, located on the octagonal portion of the barrel.

Figure 13:
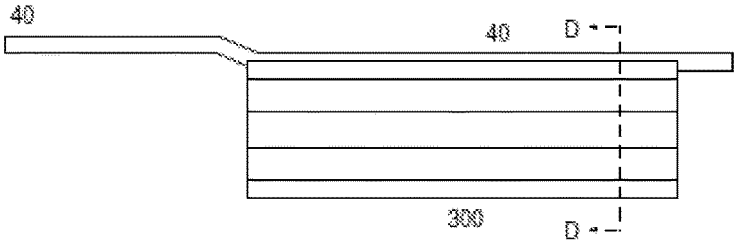
FIG. 13 is a side view that depicts the aluminum cooling extrusion and the gas tube removed from the barrel in FIG. 12 in accordance with an embodiment of the present disclosure.

FIG. 13 is a side view that depicts the aluminum cooling extrusion, Item 300, and the gas tube, Item 40, removed from the barrel in FIG. 12.

Figure 14:
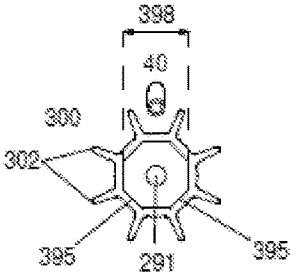
FIG. 14 depicts a cross section D-D, from FIG. 13 that illustrates the eight internal uniform flat surfaces, that would be in conformal contact with the external octagonal flats, when the aluminum cooling extrusion, has been installed on the barrel in accordance with an embodiment of the present disclosure.

FIG. 14 depicts a cross section D-D, from FIG. 13 that illustrates the eight internal uniform flat surfaces, Item 395, that would be in conformal contact with the external octagonal flats, Item 295, when the aluminum cooling extrusion, Item 300, has been installed on the barrel. Cooling fins, Item 302, are also depicted in FIG. 14. These fins increase the surface area exposed to the atmosphere increasing heat transfer from and cooling of the barrel.

The distance between opposing internal flat surfaces, Item 398, of the closed loop aluminum cooling extrusion, Item 300, is slightly less than the distance across opposing flats of the barrel, Item 298. The difference between Item 298 and Item 398 allows for an interference fit between the aluminum cooling extrusion and the barrel. Installation of the cooling extrusion over the octagonal portion of the barrel can be accomplished by mechanical means by pressing the aluminum extrusion over the barrel or by preheating the aluminum extrusion sufficient enough for the internal dimension, Item 398, to grow greater than the external dimension, Item 298, allowing the aluminum extrusion to slip over the ambient temperature barrel. As the aluminum cools it will exert a compression force rigidly affixing it to the barrel. Mechanical press fitting and thermal shrink fitting are common techniques in industry.

The distance between opposing flat surfaces, Item 398, could be slightly greater than Item 298 and thermally conductive adhesives used to firmly affix Item 300 to Item 290.

The non-circular, conformal surfaces of the barrel cooler extrusions in conjunction with the corresponding barrel surfaces insure proper orientation and location when being installed. Maintaining proper orientation and location of the cooling extrusion(s) while in use are important to prevent movement of the cooling extrusion under severe heating and potential interference with the gas tube, which is positioned near to the external surface of the barrel.

Circular internal cross section of a closed loop barrel cooler extrusion to be engaged with a circular external cross section of the barrel between the barrel lug and the gas block is also anticipated in this disclosure. Such a configuration would require fixed positioning of the cooling extrusion in correlation with the barrel when being installed to prevent interference with the gas tube. The internal ID of any single piece cooling extrusion, whether circular or not, must be greater than any barrel outside dimension after the gas block to allow the extrusion to be installed on the portion of the barrel between the barrel collar and the gas block.

The above descriptions herein also anticipate a closed loop barrel cooler fully underneath a straight gas tube exiting the gas block and entering the upper receiver without the familiar bend used to tuck the gas tube within the original hand guard of the M16. This arrangement allows for the barrel cooler to be installed without concern for interference with the gas tube.

Figure 15:
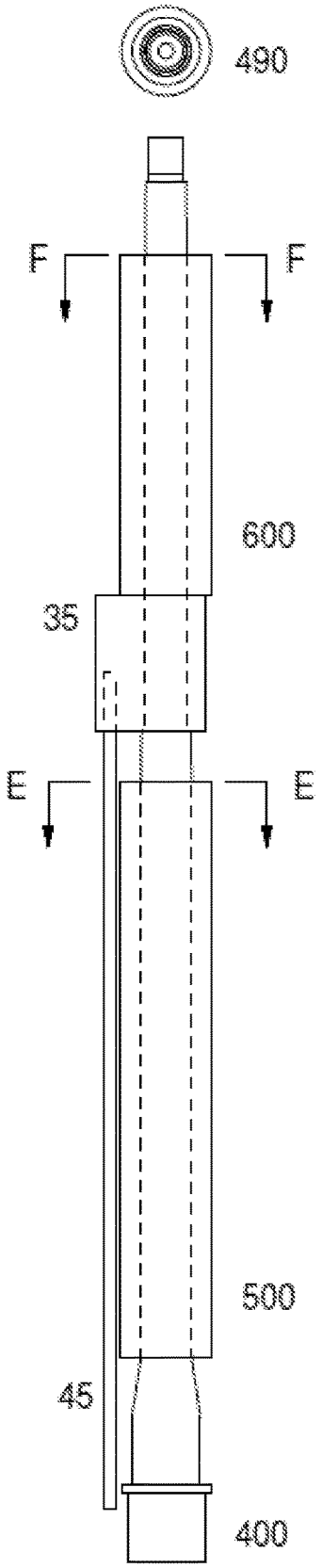
FIG. 15 depicts a side view of the barrel, configured with circular outside diameters to incorporate the closed loop barrel cooler in accordance with an embodiment of the present disclosure.

FIG. 15 depicts a side view of the barrel, Item 400, configured with circular outside diameters to incorporate closed loop barrel coolers. Item 35 depicts the gas block with gas tube, Item 45, exiting slightly higher than typical, running parallel with the barrel, entering into the upper receiver without any bends in the gas tube. Portions of the barrel, Item 400, are shown in phantom with dashed lines. Item 490 is an end view of the barrel only with the various decreasing diameters from the upper receiver towards the muzzle. Item 500 depicts the closed loop barrel cooler affixed to the barrel between the upper receiver and the gas block. Item 600 depicts the closed loop barrel cooler affixed to the barrel after the gas block. The inside diameter of Item 500 would be slightly bigger than the inside diameter of Item 600. This relationship allows for barrel cooler, Item 500, to slip easily over portion of the barrel, Item 400, where the gas block, Item 35, and different barrel cooler, Item 600, would be located.

Figure 16:
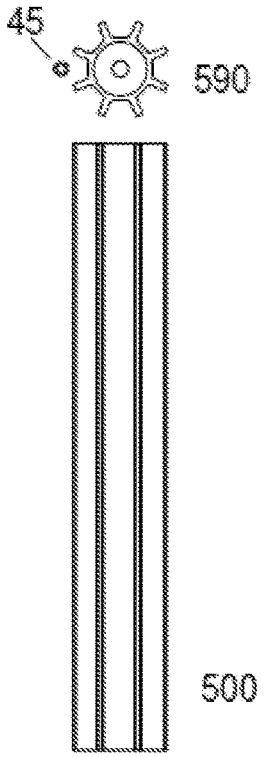
FIG. 16 depicts Item 500 removed from the barrel. Item 590 is a cross section E-E of Item 500 indicating axial fins that run parallel to the barrel bore in accordance with an embodiment of the present disclosure.

FIG. 16 depicts Item 500 removed from the barrel. Item 590 is a cross section E-E of Item 500 indicating longitudinal fins that run parallel to the barrel bore. In addition to being extruded, Item 500 could be machined from solid bar with fins that spiral around the barrel bore.

Figure 17:
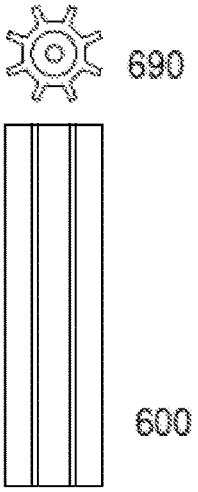
FIG. 17 depicts Item 600 removed from the barrel. Item 690 is a cross section F-F of Item 600 indicating axial fins that run parallel to the barrel bore in accordance with an embodiment of the present disclosure.

FIG. 17 depicts Item 600 removed from the barrel. Item 690 is a cross section F-F of Item 600 indicating longitudinal fins that run parallel to the barrel bore. In addition to being extruded, Item 600 could be machined from solid bar with fins that spiral around the barrel bore.

Figure 18:
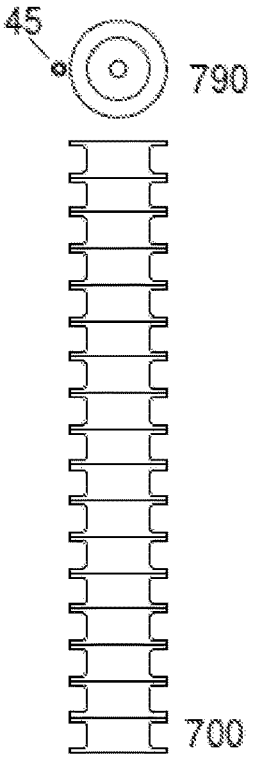
FIG. 18 depicts Item 700 removed from the barrel. Item 790 is a cross section E-E of Item 700 indicating circumferential fins around the barrel bore in accordance with an embodiment of the present disclosure.

FIG. 18 depicts Item 700 removed from the barrel. Item 790 is a cross section E-E of Item 700 indicating circumferential fins or rings around the barrel bore. Item 700 could be machined from solid bar as a single unit or numerous units affixed around the barrel. Item 700 and any of the other variations of the closed loop barrel cooler depicted and anticipated herein could be constructed from various materials and methods such as foamed copper, foamed aluminum, metal injection molded copper or steel, sintered copper, machined beryllium copper and others.

The barrel cooling system(s) using aluminum devices attached to the steel barrel, as illustrated and described herein above, anticipate the following sequence of assembly: (1) insert the barrel nut over the barrel up to the barrel collar, (2) affix the aluminum barrel cooling devices to the barrel, (3) affix the barrel to the upper receiver with the barrel nut, (4) affix the gas block at the gas block position and correspondingly the gas tube to and through the barrel nut, (5) attach the free floating hand guard, encompassing the barrel, barrel cooling system, gas tube and gas block, over and to the barrel nut.

FIGS. 19 through 26 depict barrel cooling systems that do not use aluminum cooling devices in conformal contact with the steel barrel as part of the heat transfer process. Aluminum does have a higher thermal conductivity than steel. However, aluminum has a significantly lower melting point and a higher coefficient of thermal expansion. In severe conditions of uninterrupted automatic firing, the accumulated heat in the barrel could cause the aluminum to melt, become loose, lift off from the conformal engagement with the barrel or other modes of malfunction.

FIGS. 19 through 26 depict barrel cooling systems in which the cooling fins are common, of the same part with the barrel blank steel itself. The flutes are machined into and down from the nominal formed barrel outside diameter which itself is machined down from a barrel blank stock. This embodiment of the barrel cooling system utilizes cooling fins that extend below the barrel blank by virtue of the flutes and fins machined from the barrel blank stock in relief and therefore the fins extend above the nominal formed barrel outside diameter. This configuration results in a barrel cooling system without the different material properties and potential problems mentioned previously.

FIGS. 19 through 22 illustrate a first example of the integral barrel cooling system. Item 800 is the barrel for an AR15/M16/M4 pattern rifle. Item 802 is the barrel lug or collar that abuts with the upper receiver of the rifle, which is not shown. Item 804 is the breech end of the barrel immediately after the barrel lug. Item 35 is the gas block that receives a portion of the combustion gases, which are redirected through the straight gas tube, Item 45, back toward the upper receiver to operate the mechanisms to eject a spent cartridge. Item 809 is the portion of the barrel after the gas block.

Figure 19:
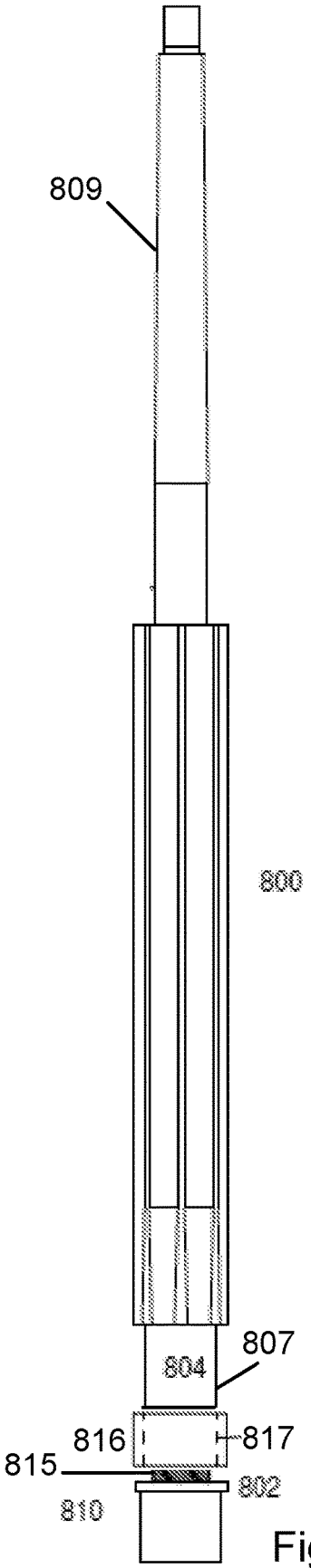
FIG. 19 illustrates the barrel extension, Item 810, with its threaded portion having been removed from the breech end, Item 804, of the barrel in accordance with an embodiment of the present disclosure.

Shown in FIG. 19 is the barrel extension, Item 810, with its threaded portion, Item 815, having been removed from the breech end, Item 804, of the barrel. The external threads, Item 815, are used to attach the barrel extension, Item 810, to the internal threads found within Item 804. The barrel nut, Item 816, has an internal diameter, Item 817, slightly greater than the barrel at Item 807.

The barrel cooling system using the integral, machined steel cooling fins as illustrated in FIGS. 19 through 22 anticipates a different and unique sequence of assembly: (1) the barrel nut, Item 816, first being located on or over the Item 804 portion of the barrel, (2) the barrel extension, Item 810, then being screwed into the breech end, Item 804, of the barrel and capturing the barrel nut, Item 816, (3) the barrel, Item 800, then being affixed to the upper receiver with the barrel nut, Item 816, (4) the gas block, Item 35, and gas tube, Item 45, being affixed to the barrel and (5) free floating hand guard, not shown for reasons of clarity, located around and encompassing the barrel cooling system, gas tube and gas block.

Figure 20:
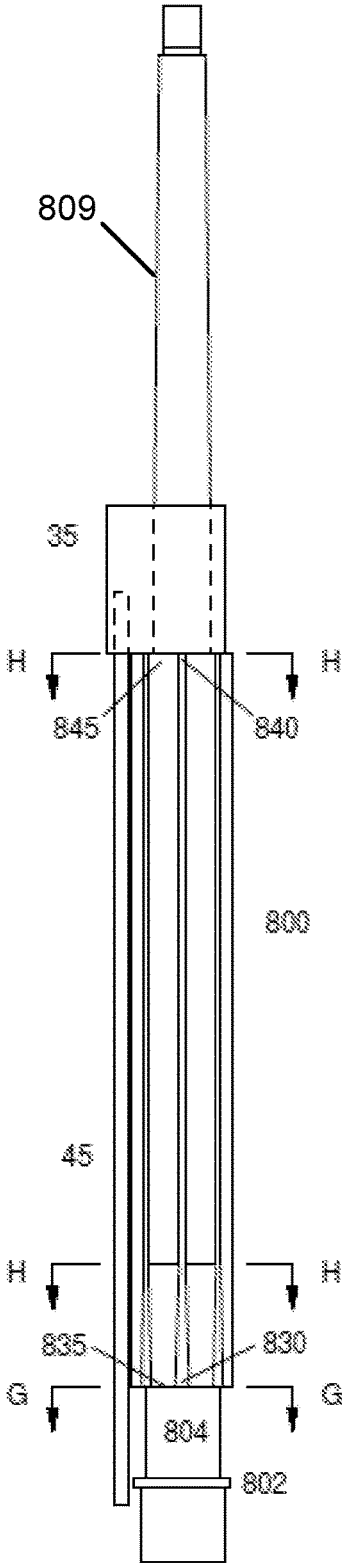
FIG. 20 illustrates a partial assembly of the barrel with the barrel extension, gas block, and gas tube, installed in accordance with an embodiment of the present disclosure.

FIG. 20 illustrates a partial assembly of the barrel, Item 800, with the barrel extension, Item 810, gas block, Item 35, and gas tube, Item 45, installed. Barrel nut, Item 816, is not shown for clarity.

Figure 21:
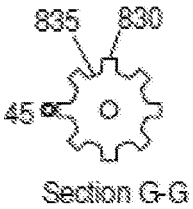
FIG. 21 illustrates Section G-G at the intersection of Item 804 with the commencement of the barrel cooling fins in accordance with an embodiment of the present disclosure.

FIG. 21 illustrates Section G-G at the intersection of Item 804 with the commencement of the barrel cooling fins, Item 830. The minor diameter of the cooling fins, Item 835, is nominally the same as the barrel diameter at Item 804.

Figure 22:
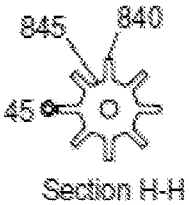
FIG. 22 illustrates Section H-H at the termination of the cooling fins and the location of the gas block and along the majority portion underneath the free floating handguard in accordance with an embodiment of the present disclosure.

FIG. 22 illustrates Section H-H at the termination of the cooling fins, Item 840, at the location of the gas block, Item 35, and along the majority portion underneath the free floating handguard. The minor diameter of the cooling fins, Item 845, for Section H-H would nominally be the same as the barrel diameter found at the gas block, Item 35.

As illustrated in FIGS. 19 through 22, the barrel cooling fins are straight and nominally parallel with the bore axis of the barrel. Although not illustrated, this application anticipates the use of spiral cooling fin patterns and other patterns in the execution of the integral barrel cooling system.

FIGS. 23 through 26 illustrate another example of the integral barrel cooling system. Item 900 is the barrel for an AR15/M16/M4 pattern rifle. Item 902 is the barrel lug or collar that abuts with the upper receiver of the rifle, which is not shown. Item 904 is the breech end portion of the barrel immediately after the barrel lug. Item 35 is the gas block that receives a portion of the combustion gases, which are redirected through the straight gas tube, Item 45, back toward the upper receiver to operate the mechanisms to eject a spent cartridge. Item 909 is the portion of the barrel after the gas block.

Figure 23:
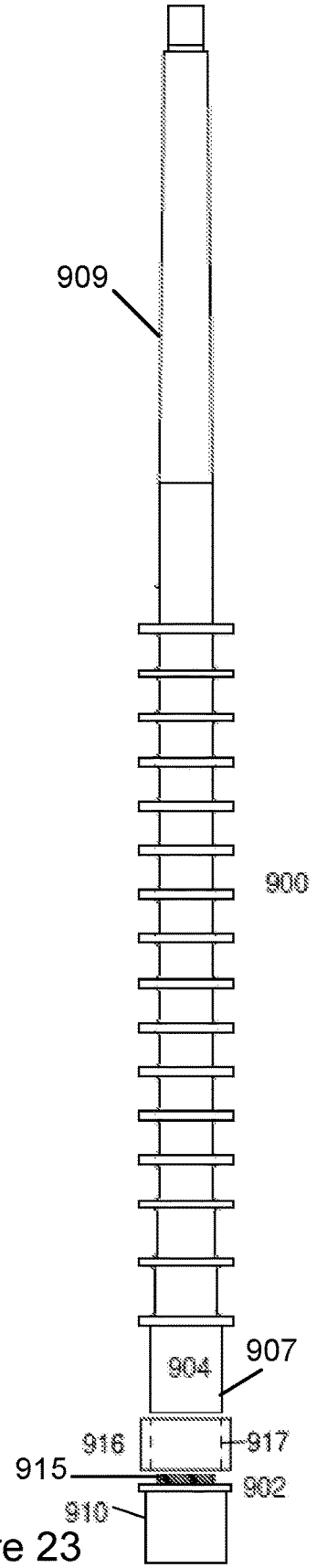
FIG. 23 illustrates the barrel extension, Item 910, with its threaded portion, having been removed from the breech end of the barrel in accordance with an embodiment of the present disclosure.

Shown in FIG. 23 is the barrel extension, Item 910, with its threaded portion, Item 915, having been removed from the breech end, Item 904, of the barrel. The external threads, Item 915, are used to attach the barrel extension, Item 910, to the internal threads found within Item 904. The barrel nut, Item 916, has an internal diameter, Item 917, slightly greater than the barrel at Item 907.

The barrel cooling system using the integral machined steel cooling fins illustrated in FIGS. 23 through 26 anticipates the different and unique sequence of assembly as described pertaining to FIGS. 19 through 22.

Figure 24:
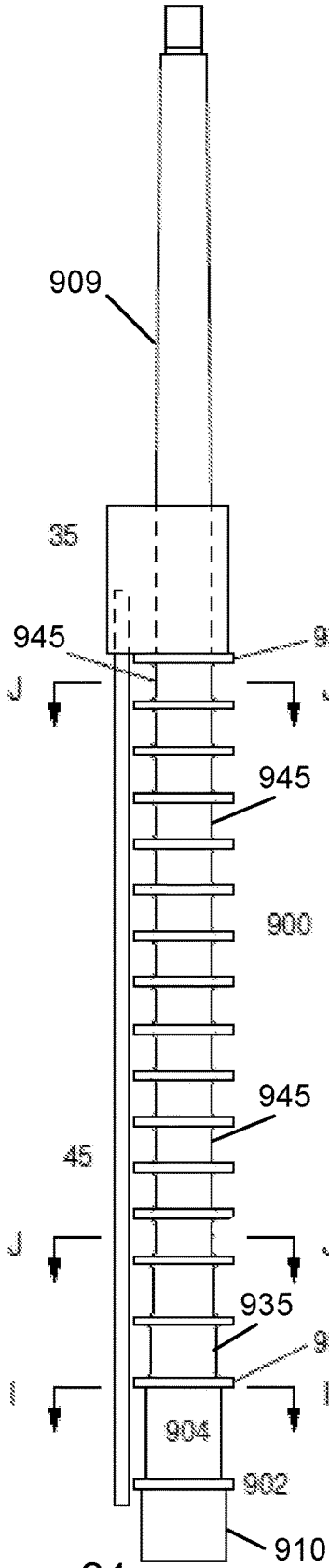
FIG. 24 illustrates a partial assembly of the barrel with the barrel extension, gas block and gas tube installed in accordance with an embodiment of the present disclosure.

FIG. 24 illustrates a partial assembly of the barrel, Item 900, with the barrel extension, Item 910, gas block, Item 35, and gas tube, Item 45, installed. Barrel nut, Item 916, is not shown for clarity.

Figure 25:
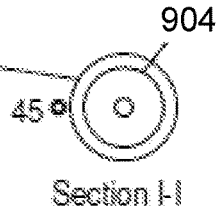
FIG. 25 illustrates Section I-I at the end of Item 904 and the commencement of the first circumferential barrel cooling rib or fin in accordance with an embodiment of the present disclosure.

FIG. 25 illustrates Section I-I at the end of Item 904 and the commencement of the first circumferential barrel cooling fin or circumferential rib, Item 930. The minor diameter of the barrel cooling system, Item 935, between the first three circumferential cooling rings, Item 930, is nominally the same or slightly smaller than the barrel diameter at Item 904.

Figure 26:
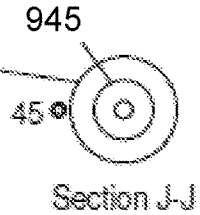
FIG. 26 illustrates Section J-J immediately prior to the last cooling fin or circumferential rib just before the gas block in accordance with an embodiment of the present disclosure.

FIG. 26 illustrates Section J-J immediately prior to the last cooling fin or circumferential rib, Item 930, just before the gas block, Item 35. The minor diameter of the barrel cooling system, Item 945, after Item 935 would be nominally the same as the barrel diameter for the gas block, Item 35.

The descriptions herein and above for various barrel cooling methods apply to other rifle operating systems, such as the AK47/AK74/AKM, use gas operated piston and rod means to cycle the bolt mechanism when ejecting a spent cartridge. The space occupied by the operating rod would nominally be the same as occupied by the gas tube described herein.

Figure 27:
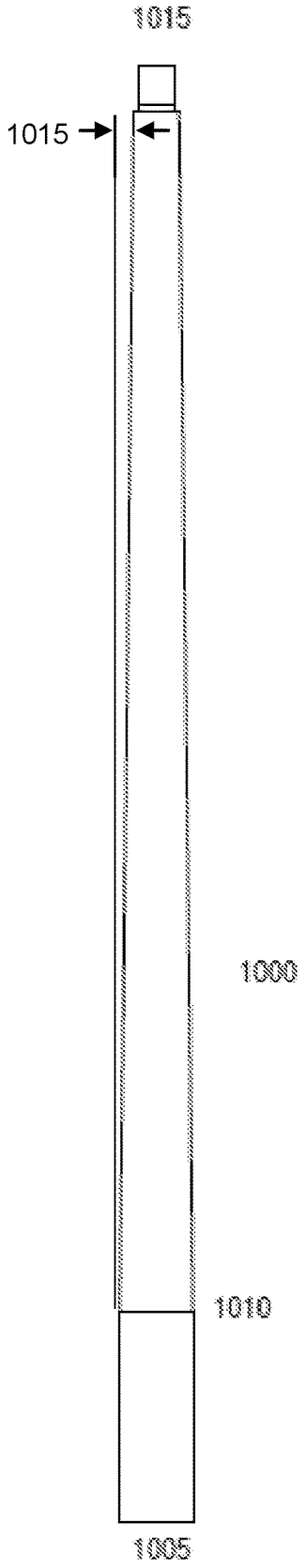
FIG. 27 illustrates a conventional blank barrel stock configured for use in a bolt action rifle.

FIG. 27 illustrates a conventional blank barrel or blank stock, Item 1000, configured for use in a bolt action rifle. The breech end of the barrel blank, Item 1005, would be attached to the action that includes into the chamber and the bolt for removing spent cartridges from the chamber. Typical to bolt action rifles, the barrel blank outside diameter at the attachment to the action stays the same for a short distance, Item 1010, before tapering down at the muzzle end of the barrel blank, Item 1015. The taper 1020 is depicted from the breech end 1005 to the muzzle end 1015.

Figure 28:
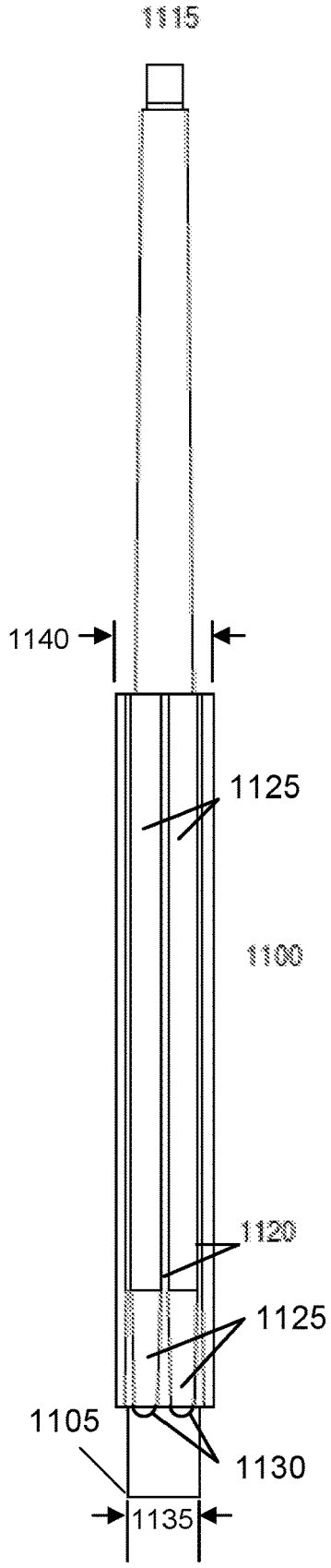
FIG. 28 illustrates a rifle barrel, Item 1100, configured for use in a bolt action rifle but also includes external cooling fins, Item 1120, as similarly illustrated in FIGS. 19 through 22 in accordance with an embodiment of the present disclosure.

FIG. 28 illustrates a formed barrel, Item 1100, configured for use in a bolt action rifle but also includes external cooling fins, Item 1120, as similarly illustrated in FIGS. 19 through 22 and flutes 1125 in accordance with an embodiment of the present disclosure. A barrel blank 1000, not drawn to scale with respect to FIG. 28, without any fins or flutes is used to form the formed barrel 1100. The start of flutes 1130 nearest the breech end 1105 of the formed barrel 1100 are depicted semicircular in elevation similar to the start of the flutes 95 in FIG. 2. A diameter of the flute starts 1130 is less than a diameter of the flutes 1125 and therefore the flutes 1124 have an intermediate diameter which sets up fins 1123 of decreasing width proximal the flute starts to a consistent width of the fins 1120. The outside diameter 1135 of the breech end 1105 of the formed barrel 1100 and the major outside diameter of the fins 1140 are indicated. The inside diameter of the flutes is equal to the outside diameter 1135 minus the radius of the flute starts 1130, also known as divots created by machining in relief from the barrel blank. The breech end 1105 of the formed barrel, Item 1100 would be attached to the action, which includes the chamber and bolt. Different than current bolt action rifle barrels, the larger diameter of the external cooling fins would preclude the use of common single piece wooden or molded plastic stocks that conform to the external profile of bolt action barrels as seen in Item 1000 of FIG. 27. Chassis type rifle stocks that utilize free floating hand guards with sufficient internal diameter could be used to mount the finned barrel to the rifle action. Employing externally finned barrels would increase barrel stiffness and barrel cooling, benefiting the accuracy of bolt action rifles versus heavy bull barrels, while weighing less as well.

Figure 29:
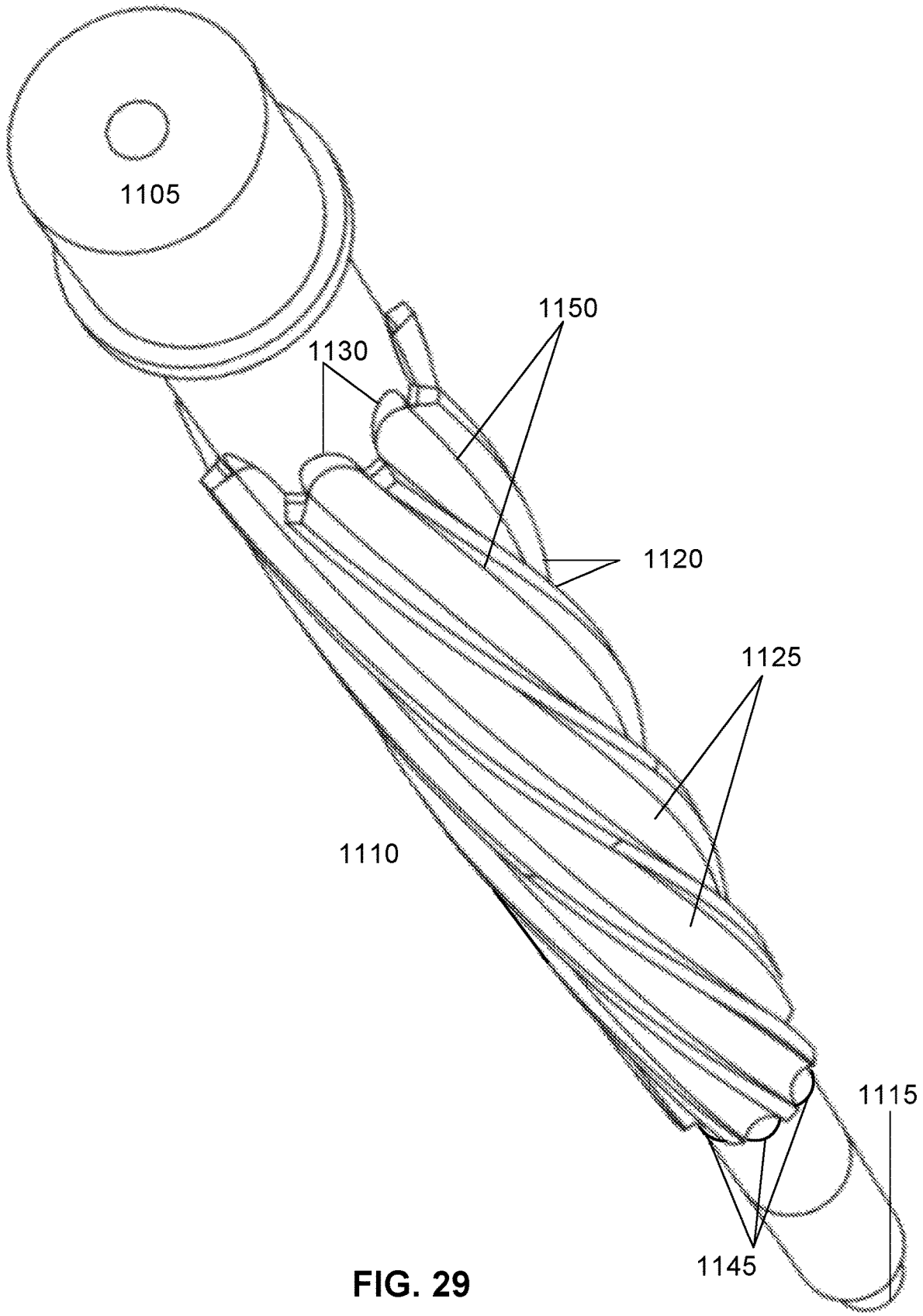
FIG. 29 depicts a spiral fluted firearm cooling barrel configured to match the taper of a blank stock in accordance with an embodiment of the present disclosure.

FIG. 29 depicts a spiral fluted firearm cooling barrel configured to match the taper of a blank stock in accordance with an embodiment of the present disclosure. The depiction 1110 includes the breech end of the barrel 1105, the muzzle end of the barrel 1115, the fins 1120, the flutes 1125, the start of the flutes 1130, the flute end divots 1145 created by machining in relief in the blank barrel and the intersection 1150 of the flutes 1125 with the fins 1120. The flute to fin transition 1150 follows the taper of the barrel 1020 (similar to the taper depicted in FIG. 27) at any circumferential point on the barrel. The transition occurs at the intersection point of a base of a fin to the crest of a flute, depicted as the same point 1150 continuing along the taper of the barrel.

Figure 30:
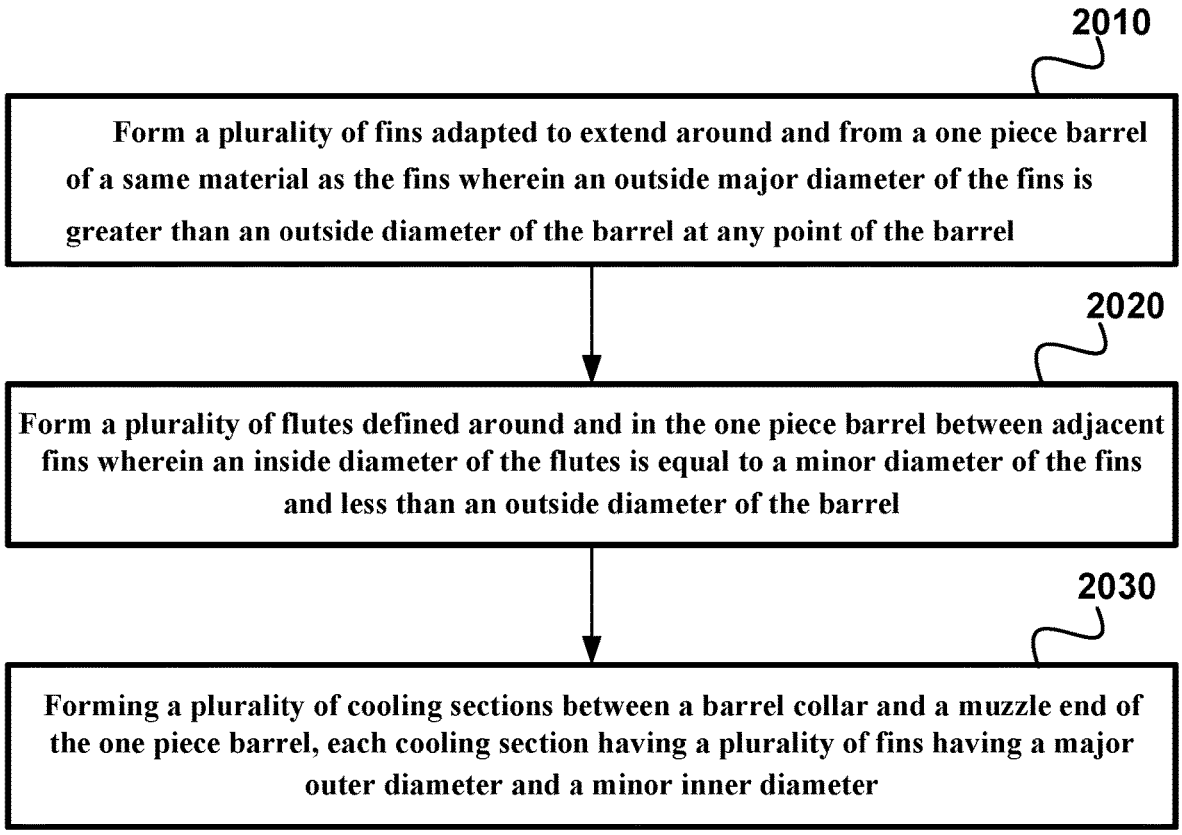
FIG. 30 depicts a flow diagram for a firearm cooling method in accordance with an embodiment of the present disclosure.

FIG. 30 depicts a flow diagram for a firearm cooling method in accordance with an embodiment of the present disclosure. A firearm barrel cooling method comprises forming 2010 a plurality of fins adapted to extend around and from a one-piece barrel blank of a same material as the fins wherein an outside major diameter of the fins is greater than an outside diameter of the formed barrel at any point of the barrel. The method also includes forming 2020 a plurality of flutes defined around and in the one-piece formed barrel between adjacent fins wherein an inside diameter of the flutes is equal to a minor diameter of the fins and less than an outside diameter of the formed barrel. The method additionally includes forming 2030 a plurality of cooling sections between a barrel collar and a muzzle end of the solid barrel, each cooling section having a plurality of fins having a major outer diameter and a minor inner diameter.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A firearm barrel cooling system comprising:

a formed barrel having a base surface which tapers between a breech end to a muzzle end formed from a barrel blank;

a plurality of fins raised above the base surface and following the taper between the breech end and the muzzle end of the barrel blank, each fin oriented along a longitudinal length of the formed barrel, the plurality of fins of a same material as the formed barrel, wherein each fin extends radially out and above the base surface; and a plurality of flutes recessed below the base surface and following the taper, each flute oriented along the longitudinal length of the formed barrel and positioned between two of the plurality of fins, each flute forming a transition line with the adjacent fins, the transition line coincident with the base surface and following the taper of the formed barrel between the breech end to the muzzle end thereof.

2. The firearm barrel cooling system of claim 1, wherein the fins and the flutes follow a helical configuration along a longitudinal length of the formed barrel.

3. The firearm barrel cooling system of claim 1, wherein a number of flutes is equal to a number of fins.

4. The firearm barrel cooling system of claim 1, wherein an end of the plurality of fins and an end of the plurality of flutes are noncoincidental.

* * * * *